US007140304B1

(12) United States Patent
Lawrie

(10) Patent No.: US 7,140,304 B1
(45) Date of Patent: Nov. 28, 2006

(54) FLEXIBLE TOOL AND PARTS TRAY

(76) Inventor: Warwick W. Lawrie, 418 Sloan Rd., Nashville, TN (US) 37209

( * ) Notice: Subject to any disclaimer, the term of this patent is extended or adjusted under 35 U.S.C. 154(b) by 231 days.

(21) Appl. No.: 10/765,543

(22) Filed: Jan. 27, 2004

(51) Int. Cl.
*A47B 85/00* (2006.01)

(52) U.S. Cl. ..... 108/25; 108/44

(58) Field of Classification Search ..... 108/44, 108/45, 26, 25; 248/309.4
See application file for complete search history.

(56) References Cited

U.S. PATENT DOCUMENTS 2,481,233 A * 9/1949 Morset ..... 108/55.3
3,034,153 A * 5/1962 Sargent ..... 108/25
4,026,219 A * 5/1977 Shupe et al. ..... 108/13
4,770,155 A * 9/1988 Chamberlain et al. ..... 108/44
4,940,003 A * 7/1990 Mayhew et al. ..... 108/44
4,958,577 A * 9/1990 Demaio et al. ..... 108/43
5,720,226 A * 2/1998 Padovano ..... 108/25
5,760,668 A * 6/1998 Testa et al. ..... 248/309.4
5,884,566 A * 3/1999 Chen ..... 108/67
6,164,213 A * 12/2000 Topps et al. ..... 108/25
6,315,120 B1 11/2001 Tally et al. ..... 206/373
6,910,429 B1 * 6/2005 Matay et al. ..... 108/44

OTHER PUBLICATIONS

Ernst Products; Gripper Wrench Organizers; information from the internet; undated, admitted prior art.

* cited by examiner

*Primary Examiner*—Jose V. Chen
(74) *Attorney, Agent, or Firm*—MacCord Mason PLLC

(57) ABSTRACT

A tool tray apparatus including flexible pad and a plurality of spaced apart, rigid rods connected to the pad.

23 Claims, 5 Drawing Sheets

FLEXIBLE TOOL AND PARTS TRAY

BACKGROUND OF THE INVENTION (1) Field of the Invention

The present invention relates generally to a tool tray and, more particularly, to a flexible tool tray having a generally rectangular tool area for supporting tools and at least one pair of rigid rods for reducing flexibility of the tray along the direction parallel to the rods and allowing flexibility along the direction perpendicular to the rods.

(2) Description of the Prior Art

A motor vehicle technician or repairperson often works under the hood of a vehicle. This may put the technician in a position that makes it difficult for him/her to reach a tool or part needed to affect a repair. Thus, the person must temporarily leave the work area to secure the tool or part. Then the repairperson must contort him/herself back into position under the hood of the vehicle. Such contortions may lead to productivity-robbing fatigue and/or injury to the repairperson.

Rigid tool trays have been designed to alleviate such problems but the trays are often not capable of remaining in position close to the repairperson under the hood of a vehicle. Thus, the repairperson must reach for tools in such a tray only to topple the tray and splatter tools and parts across the floor of the work area.

Thus, there remains a need for a new and improved tool tray that will remain secure in position under the hood of a vehicle in an area such as on the top of the vehicle's intake manifold of heads, for example.

SUMMARY OF THE INVENTION

A flexible tool tray, said apparatus comprising: (a) a generally rectangular flexible pad forming a tool area for supporting tools; (b) a plurality of spaced apart rigid rods extending substantially the length of said pad and parallel to opposite sides of said pad for reducing flexibility of said pad along the direction parallel to said rods while, at the same time, permitting flexibility of said pad along the direction perpendicular to said rods; (c) at least one pair of spaced apart rigid rods adjacent opposite ends of said tool area extending substantially the length of said pad and parallel to opposite sides of said pad for reducing flexibility of said pad along the direction parallel to said rods while, at the same time, permitting flexibility of said pad along the direction perpendicular to said rods; and (d) at least one parts area for holding parts.

An embodiment may further including at least one parts area for holding parts, which may include at least one parts tray. The parts tray may be rectangular shaped and/or include vertical sides and/or a magnetic sheet for retaining parts in the parts tray.

In an embodiment, the upper surface of the flexible pad may include ridges for retaining tools in the tool area. The bottom surface of the flexible pad may include serrations for holding the tool tray onto a work surface.

The rigid rods may be metal rods having a diameter between about 1/16 inch and 1/8 inch. The flexible tool tray may include a receptacle for installing an upright frame to provide a gauge rest and/or an interior wall at least partially defining a recess for holding a specific part in the tray and/or a magnet for holding the tray to a metallic surface.

Accordingly, one aspect of the present invention is to provide a flexible tool tray, the apparatus comprising: (a) a generally rectangular flexible pad forming a tool area for supporting tools; and (b) at least one pair of rigid rods extending substantially the length of said pad and parallel to opposite sides of said pad for reducing flexibility of said pad along the direction parallel to said rods while permitting flexibility of said pad along the direction perpendicular to said rods.

Another aspect of the present invention is to provide a flexible tool tray, the apparatus comprising: (a) a generally rectangular flexible pad forming a tool area for supporting tools; (b) at least one pair of rigid rods extending substantially the length of said pad and parallel to opposite sides of said pad for reducing flexibility of said pad along the direction parallel to said rods while, at the same time, permitting flexibility of said pad along the direction perpendicular to said rods; and (c) at least one pair of spaced apart rigid rods adjacent opposite ends of said tool area extending substantially the length of said pad and parallel to opposite sides of said pad for reducing flexibility of said pad along the direction parallel to said rods while, at the same time, permitting flexibility of said pad along the direction perpendicular to said rods.

These and other aspects of the present invention will become apparent to those skilled in the art after a reading of the following description of the preferred embodiment when considered with the drawings.

DESCRIPTION OF THE PREFERRED EMBODIMENTS

Figure 1:
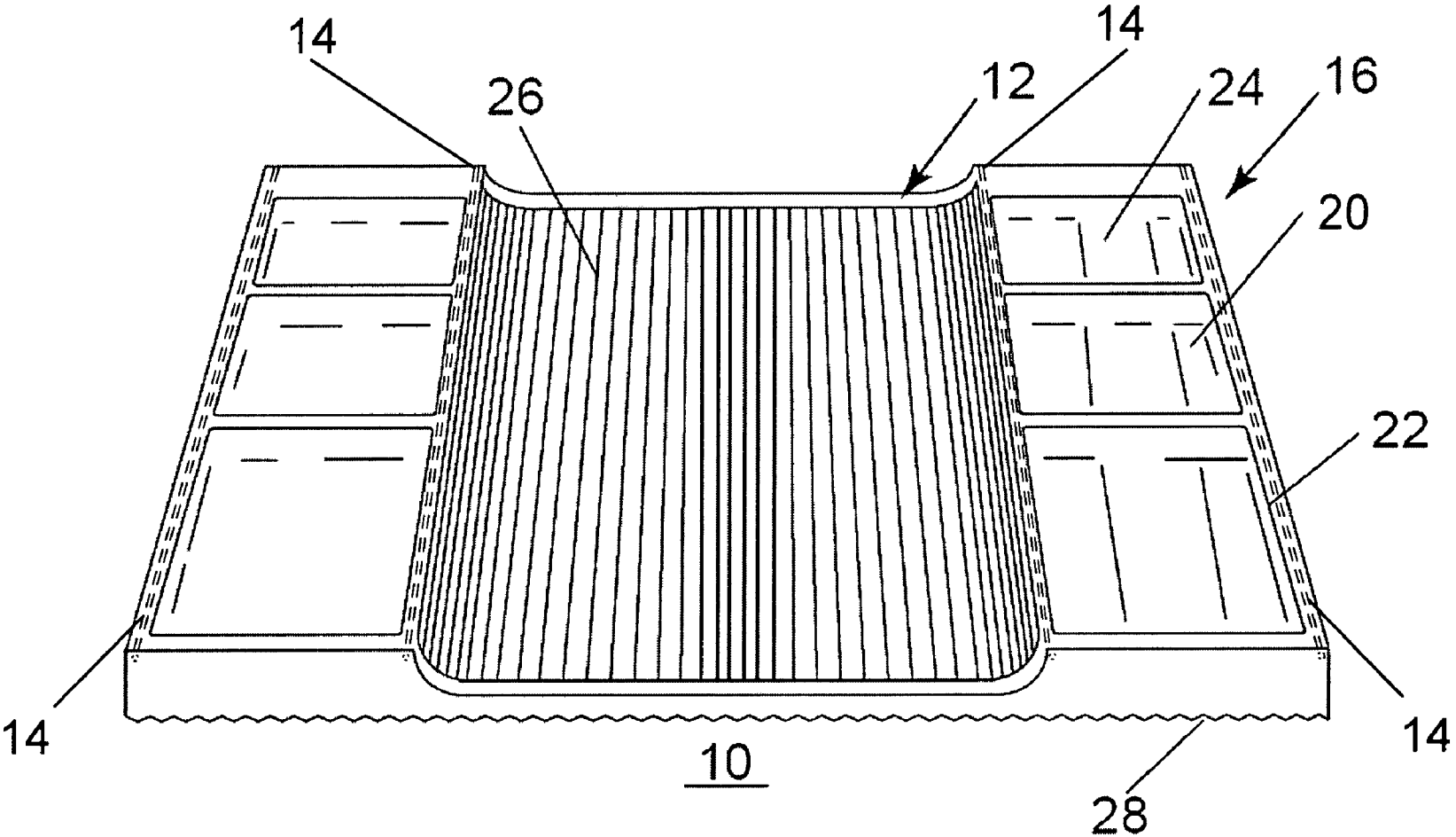
FIG. 1 is a front perspective view of a tool tray.

In the following description, like reference characters designate like or corresponding parts throughout the several views. Also in the following description, it is to be understood that such terms as "forward," "rearward," "left," "right," "upwardly," "downwardly," and the like are words of convenience and are not to be construed as limiting terms.

Referring now to the drawings in general and FIG. 1 in particular, it will be understood that the illustrations are for the purpose of describing a preferred embodiment of the invention and are not intended to limit the invention thereto. As best seen in FIG. 1, a flexible tool and parts tray, generally designated 10, is shown constructed according to the present invention. The flexible tool and parts tray 10 includes a generally rectangular flexible pad 12 forming a tool area for supporting tools. The upper surface the flexible pad 12 may include ridges 26 for retaining tools in the tool area and the bottom surface of the pad 12 includes serrations 28 for holding the tool tray 10 on a work surface such as the top of a vehicle engine.

The tray 10 also includes at least one parts area 16 including at least one rectangular-shaped parts tray 20 having vertical sides 22 for holding small parts such as nuts, washers, bolts and other small parts included in vehicle engines. The parts tray 20 may also include a magnetic sheet 24 for retaining such small parts in the tray 20.

Figure 2:
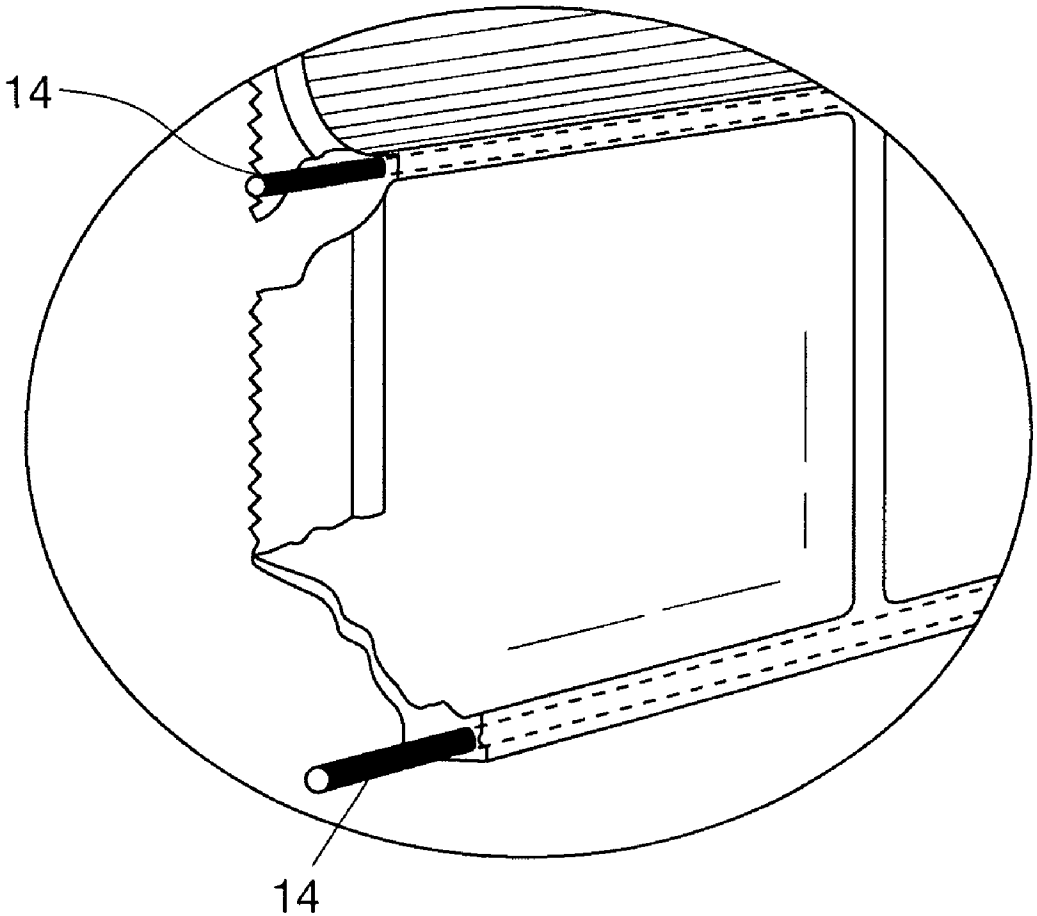
FIG. 2 is an enlarged cutaway view of a corner of the tool tray shown in FIG. 1, thus illustrating a rod in position for the rigidity of that parallel.
Figure 3:
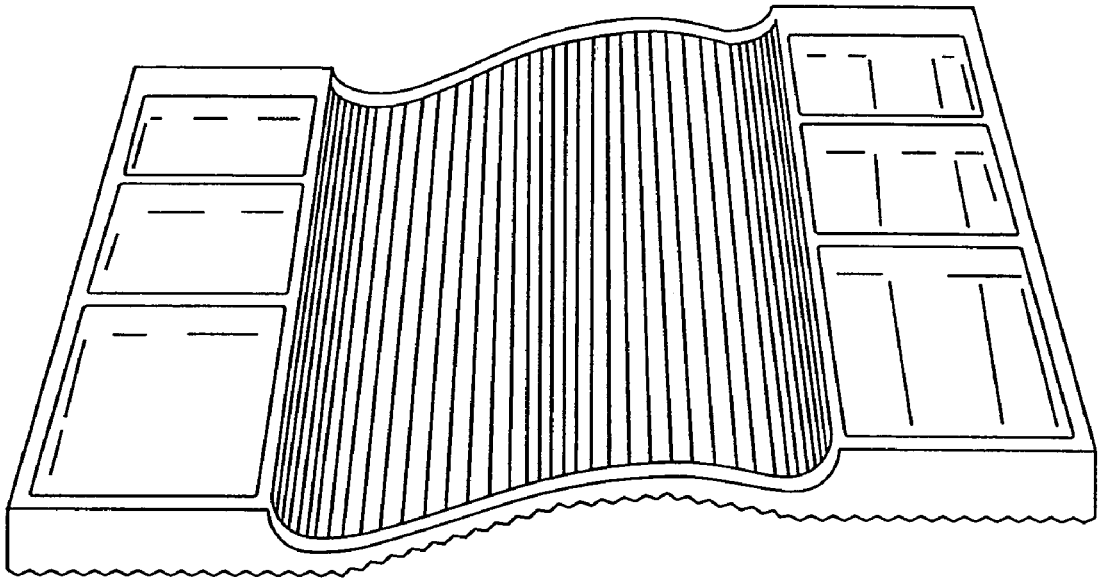
FIG. 3 is a front perspective view of the tool tray showing the rigidity of the tray in one direction and the flexibility of the tray in another.

Turning now to FIG. 2, an enlarged view of the front corner, as shown in FIG. 1, of the tray 10 is shown. The tray 10 includes at least one pair of rigid rods, such as the rod 14, (also shown in hidden view in FIGS. 1 and 5) extending substantially the length of the pad 12 and parallel to opposite sides of the pad 12. In the embodiment shown a rod 14 is present proximate each of the opposite sides of the tool area of the tray 10 and another present proximate each of two opposing outer sides of the pad 12. These rods 14 reduce the flexibility of the pad along the direction parallel to the rods 14 while, at the same time, permit flexibility of the pad 12 along the direction perpendicular to the rods 14. The rigid rods may be metal rods having a diameter between about 1/16 inch and 1/8 inch. FIG. 3 shows the flexibility of the tray in the direction perpendicular to the rods and the rigidity of the tray in the direction parallel to the rods.

Figure 4:
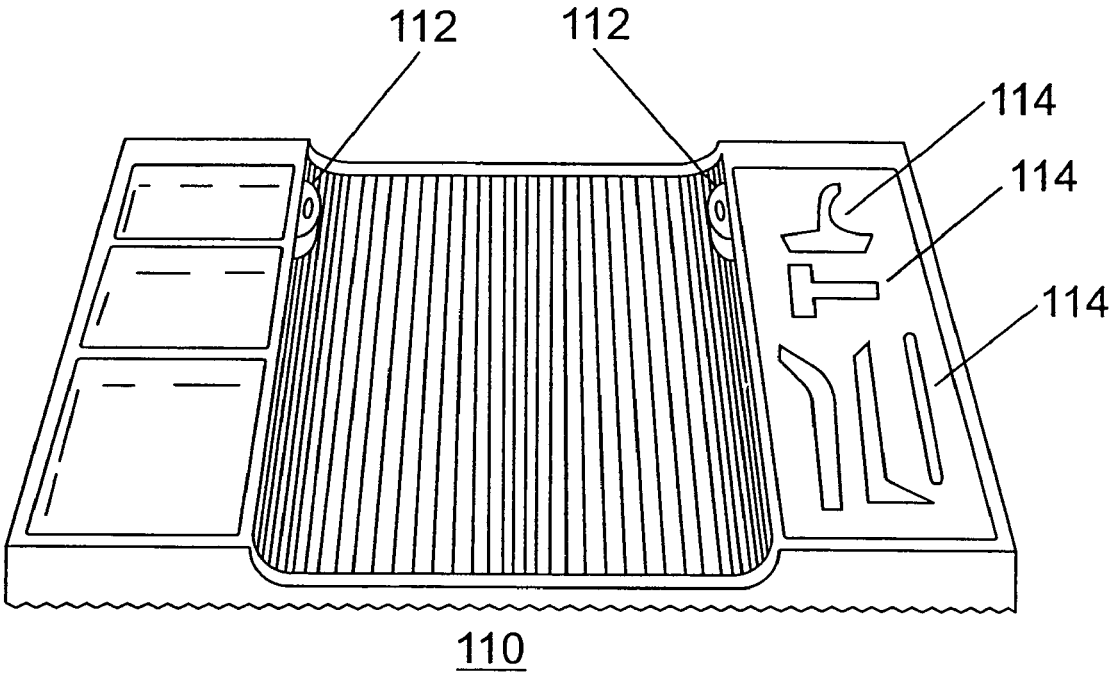
FIG. 4 is a front perspective view of an alternative embodiment of the tool tray.

FIG. 4 is a front perspective view of an alternative embodiment of a tool tray 110 showing a receptacle 112 for installing an upright frame to provide a rest for a gauge. Such an upright frame may also support an illumination device, a multi-meter, or other tool, gauge, device or apparatus. Also shown in FIG. 4 is an interior wall 114 at least partially defining a recess for holding a specific part in the parts area of the tool tray.

Figure 5:
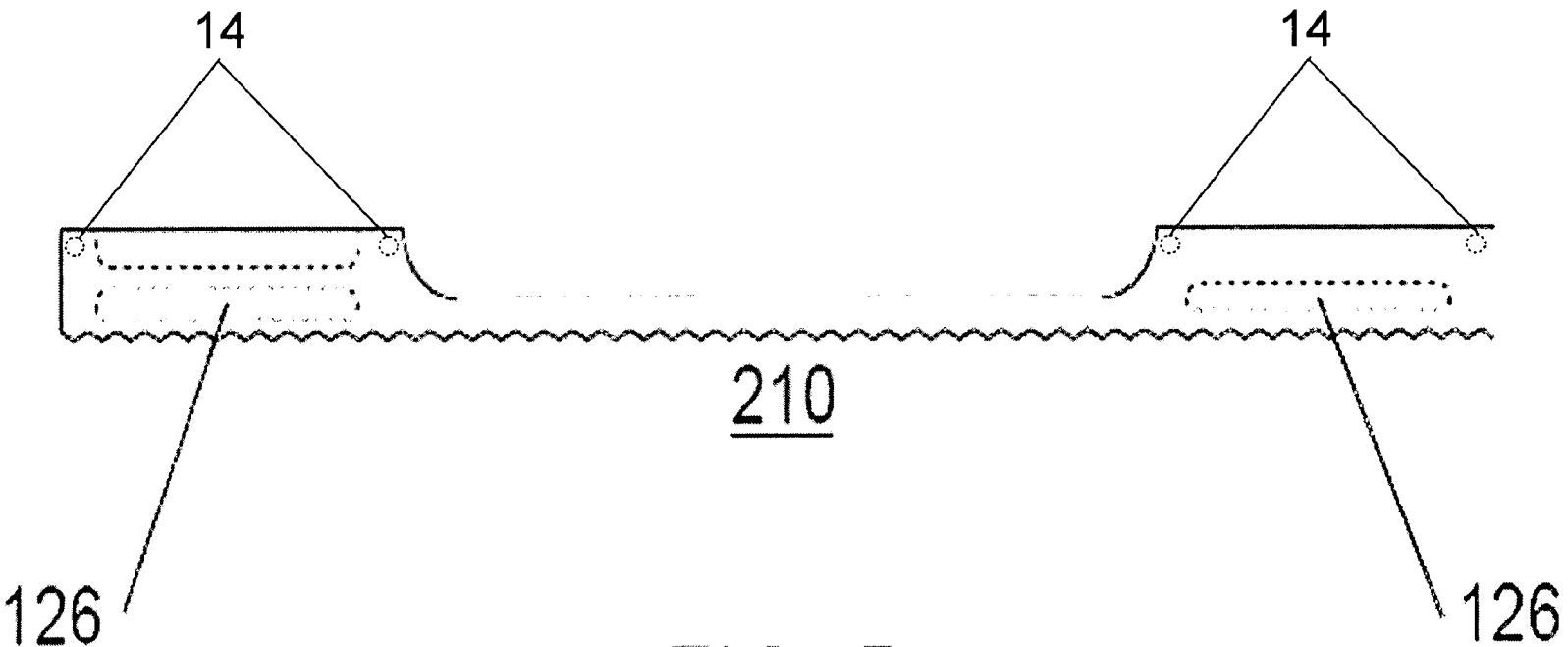
FIG. 5 is a front view of a tool tray.

FIG. 5 is a front view of a tool tray showing a magnet 126, in hidden view, for holding the tool tray 210 to a metal surface such as a vehicle fender. The tool tray may include a plurality of magnets near the bottom of the tray as shown.

Certain modifications and improvements will occur to those skilled in the art upon a reading of the foregoing description. By way of example, the tool area could be place where the parts area is shown, or vice versa, or arranged in other desirable places on the tool tray. Also, the tool tray could be round, oval or other various desirable shapes. It should be understood that all such modifications and improvements have been deleted herein for the sake of conciseness and readability but are properly within the scope of the following claims.

I claim:

1. A tool tray apparatus comprising:

(a) a pad having flexibility and comprising a plurality of interconnected walls defining an outer margin of the tray and an area comprising an entirely continuous surface between the walls; and (b) at least one pair of rigid rods connected to said pad proximate said outer margin reducing said flexibility of said pad along axes transverse the rods; and (c) at least one additional rod positioned between said pair of rigid rods further reducing said flexibility along said axes.

2. The apparatus according to claim 1 further including at least one parts area for holding parts.

3. The apparatus according to claim 2 wherein said parts area includes at least one parts tray.

4. The apparatus according to claim 3, wherein said parts tray is rectangular shaped.

5. The apparatus according to claim 3, wherein said parts tray includes vertical sides for retaining parts in said parts tray.

6. The apparatus according to claim 3, wherein said parts tray includes a magnetic sheet for retaining parts in said parts tray.

7. A tool tray apparatus comprising:

(a) a flexible pad comprising a plurality of outer walls defining an outer margin of the tray and an entirely continuous surface between said outer walls to prevent objects from passing through said pad between said outer walls;

(b) a pair of interior walls within said outer walls at least partially defining a tool area there between;

(c) at least one pair of rigid rods proximate said outer margin of said pad reducing the flexibility of said pad along axes transverse said rods; and (d) at least one pair of spaced apart, rigid rods with each of the pair proximate one of the pair of interior walls.

8. The apparatus according to claim 7, wherein the upper surface of said flexible pad includes ridges for retaining tools in said tool area.

9. The apparatus according to claim 7, wherein the bottom surface of said flexible pad includes serrations for holding said tool tray onto a work surface.

10. The apparatus according to claim 7, wherein said rigid rods are metal rods having a diameter between about 1/16 inch and 1/8 inch.

11. The apparatus according to claim 7, wherein said flexible tool tray includes a receptacle for installing an upright frame to provide a gauge rest.

12. The apparatus according to claim 7, wherein said flexible tool tray includes an interior wall at least partially defining a recess for holding a specific part in said tray.

13. The apparatus according to claim 7, wherein flexible tool tray includes a magnet for holding said tray to a metallic surface.

14. A tool tray apparatus comprising:

(a) a flexible pad;

(b) a pair of opposed interior walls extending upwardly in the pad and defining a tool area there between;

(c) a pair of outer walls extending upwardly in the pad, each of the pair opposing one of the pair of opposed interior walls;

(d) a plurality of transverse walls extending upwardly in the pad, each of the transverse walls connected at one end to one of the opposed interior walls and at an opposite end to one of the outer walls to form a plurality of opposing parts receptacles on the pad;

(e) a tool area on between the opposing parts receptacles at least partially defined by the interior walls; and (f) a pair of rigid rods, each of the pair positioned proximate on one of the pair of opposed interior walls, the pair of rigid rods rigidifying the tray against flexibility along axes transverse the interior walls.

15. The apparatus according to claim 14, wherein said parts receptacles are rectangular shaped.

16. The apparatus according to claim 14, wherein said parts receptacles includes vertical sides for retaining parts.

17. The apparatus according to claim 14, wherein said parts receptacles include a magnetic sheet for retaining parts.

18. The apparatus according to claim 14, wherein the upper surface of said flexible pad includes ridges for retaining tools in said tool area.

19. The apparatus according to claim 14, wherein the bottom surface of said flexible pad includes serrations for holding said tool tray onto a work surface.

20. The apparatus according to claim 14, wherein said rigid rods are metal rods having a diameter between about 1/16 inch and 1/8 inch.

21. The apparatus according to claim 14, wherein said tool tray includes a receptacle for installing an upright frame to provide a gauge rest.

22. The apparatus according to claim 14, wherein said tool tray includes a wall at least partially defining a recess for holding a specific part in said tray.

23. The apparatus according to claim 14, wherein tool tray includes a magnet for holding said tray to a metallic surface.

* * * * *